United States Patent [19]

Pfotenhauer

[11] 3,968,783

[45] July 13, 1976

[54] CROSSBOW TYPE GUN

[76] Inventor: James M. Pfotenhauer, 1302 N. 19th St., Escanaba, Mich. 49829

[22] Filed: July 11, 1974

[21] Appl. No.: 487,636

[52] U.S. Cl. ..... 124/25; 124/53; 124/35 A; 124/41 R; 124/40; 124/80

[51] Int. Cl.[2] ..... F41B 7/00

[58] Field of Search ..... 124/25, 30 R, 30 A, 124/35 R, 35 A, 20 A, 52, 53, 41 R, 41 A, 22, 48, 12

[56] References Cited

UNITED STATES PATENTS

| | | | |
|---|---|---|---|
| 1,375,990 | 4/1921 | Yorgensen | 124/25 |
| 2,313,803 | 3/1943 | Carlson | 124/25 |
| 3,224,427 | 12/1965 | Ronan | 124/25 |
| 3,447,527 | 6/1969 | Cermak et al. | 124/52 |
| 3,739,765 | 6/1973 | Moore | 124/25 |

FOREIGN PATENTS OR APPLICATIONS

| | | | |
|---|---|---|---|
| 43,791 | 1908 | Switzerland | 124/25 |

*Primary Examiner*—Richard C. Pinkham
*Assistant Examiner*—William R. Browne
*Attorney, Agent, or Firm*—Burns, Doane, Swecker & Mathis

[57] ABSTRACT

A bow gun comprising a body having a channel disposed therein, the channel including a projectile discharge opening. A magazine chamber communicates with the channel for storing a plurality of projectiles for sequential discharge. A bow is mounted on the body, the bow carrying a bow string. An impulse slide is disposed for reciprocal movement within the channel and is operably connected to the bow string. A cocking slide is disposed for reciprocal movement in the channel to shift the impulse slide rearwardly in the channel. A manually actuable cocking lever is pivotally mounted to the gun body and is operably connected to the cocking slide. Actuation of the cocking lever effects rearward movement of the cocking slide to shift the impulse slide rearwardly toward a cocked position. A trigger is provided for retaining the impulse slide in a cocked position and for releasing the impulse slide for forward movement toward a projectile under the bias of the bow string. A portion of the impulse slide is disposed above the magazine chamber subsequent to discharge of one projectile to prevent premature entry of another projectile into the discharge bore. The gun body comprises a pair of housing sections releasably secured together. The housing sections are divided along a plane defined essentially by the central axis of the channel. An adaptor unit is provided for converting the gun into a ball-ejecting gun.

15 Claims, 21 Drawing Figures

10
12
17
18
19
20
22
34
40
64
66
68
70
80
88
100
101
104
109
112
122
124
130
134
136
162
166
210
218
220
222
230
232
8.
10.
11.
12.

FIG. 11
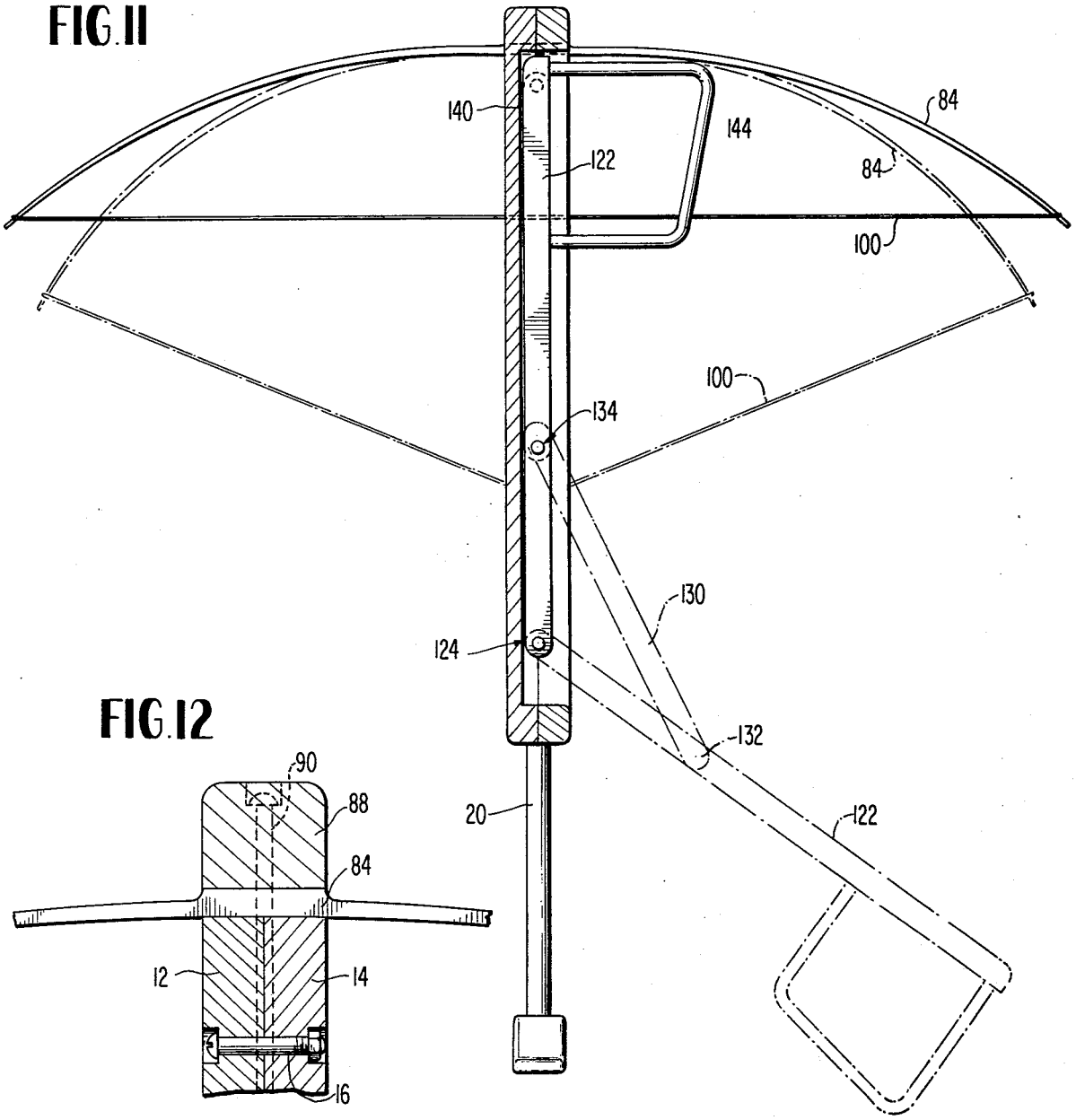
FIG. 12
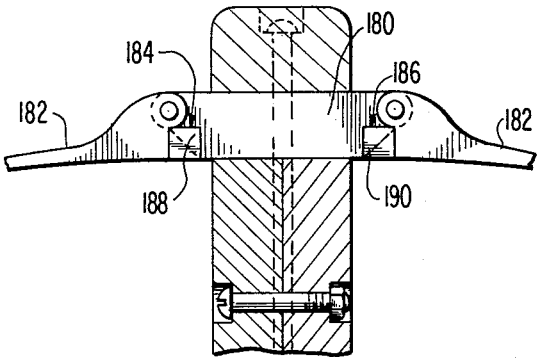
FIG. 13
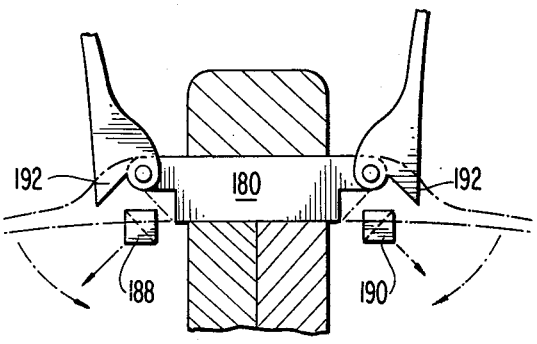
FIG. 14

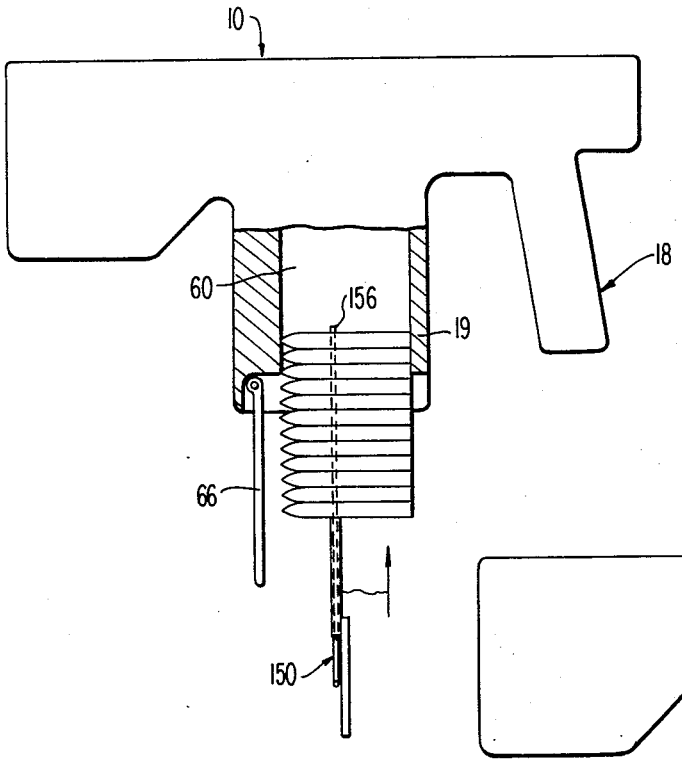
FIG.15
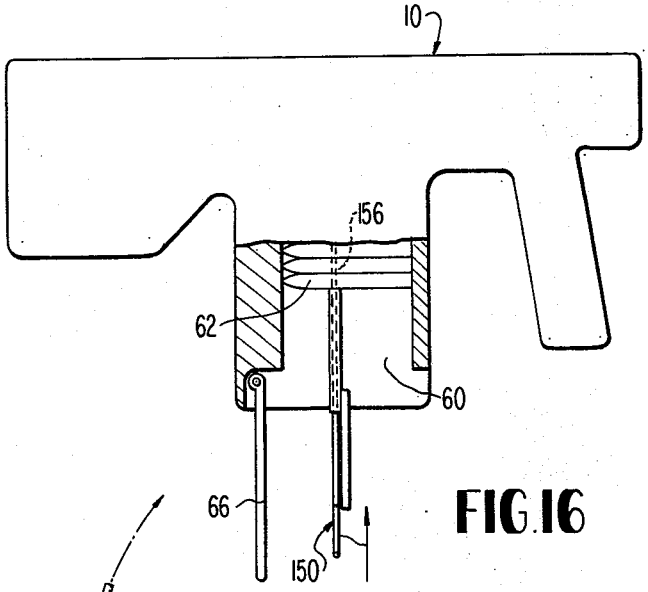
FIG.16
FIG.17
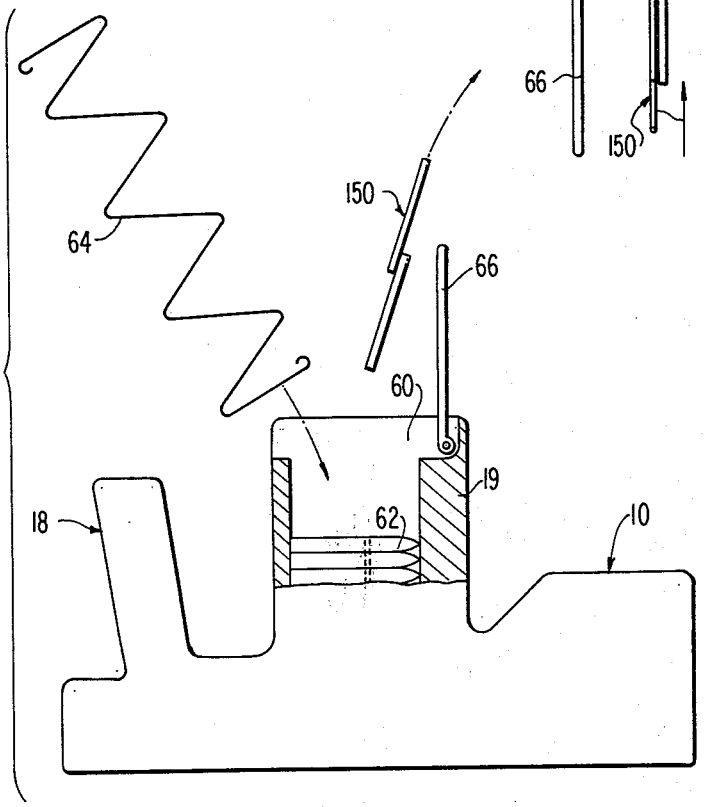

FIG.18
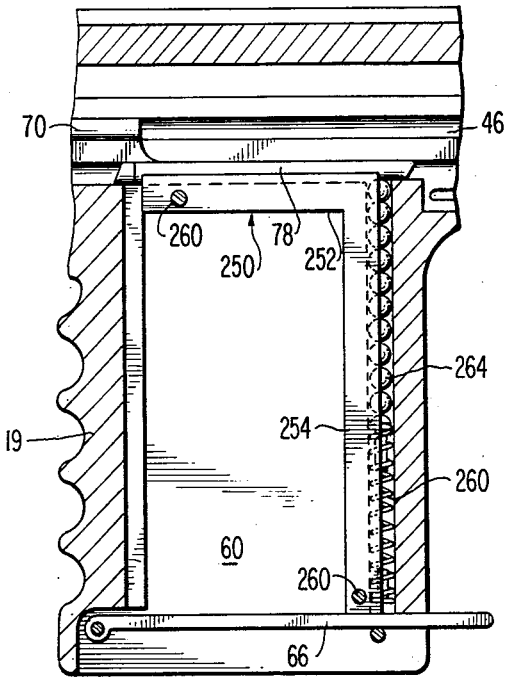
FIG.19
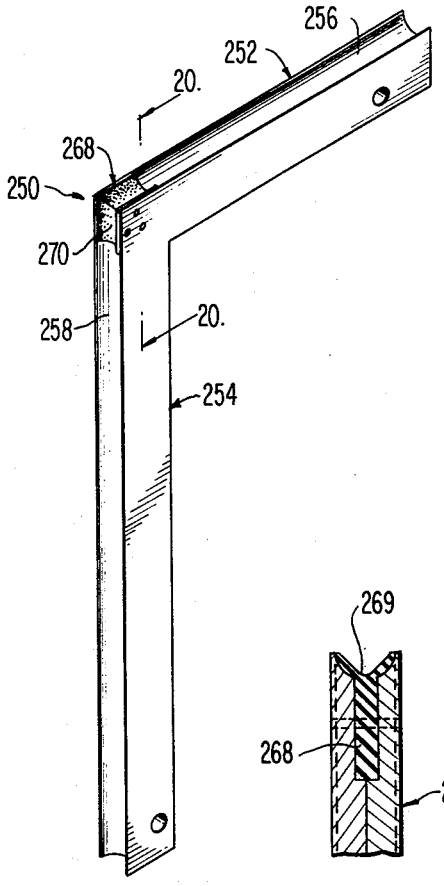
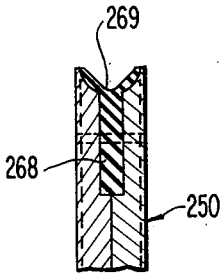
FIG.20
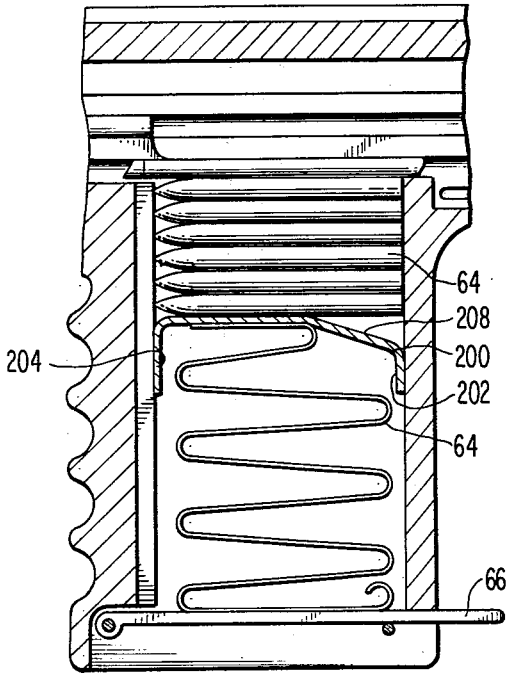
FIG.21

CROSSBOW TYPE GUN

BACKGROUND OF THE INVENTION

The present invention relates to bow guns of the type capable of storing and launching a plurality of projectiles in sequence.

Bow guns, employed widely during the middle ages, are still popular today as hunting weapons in many sportsmen's circles. The bow gun is employed to fire a projectile, such as an arrow or dart, from a runway or discharge channel. In use, a bow string is cocked to a point behind the projectile and is mechanically fixed in such a position until activation of a trigger releases the bow string to launch the projectile toward its target.

Numerous modifications of the classical bow gun design have been proposed. See, for example, U.S. Pat. Nos. 3,561,419 (issued on Feb. 9, 1971), 3,670,711 issued on June 20, 1972), and 3,739,765 (issued on June 19, 1973) for discussions pertaining to bow guns.

In spite of these and other proposals, there remains the need for a simplistic bow gun which can economically and effectively satisfy the performance requirements of present day bow gun fanciers. To be useful as a hunter's weapon, a bow gun should possess rapid fire capabilities without the use of unduly expensive and sophisticated repeater mechanisms. The moving parts should be few in number and protectively located, yet easily accessible. Cocking should be easy and convenient and accomplished in a manner which produces minimal wear of the bow string. Loading should be as quick and foolproof as possible.

It is, therefore, an object of the present invention to incorporate all of these features in a bow gun.

It is another object of the present invention to maximize the performance and effectiveness of bow guns at a cost suited to the average sportsman.

It is another object of the invention to provide a reliable and accurate bow gun which features an essentially jam-proof repeater type firing action by means of relatively few moving parts.

It is a further object of the invention to provide such a bow gun which is compact, easy to cock, and provides quick access to its internal parts.

It is a further object of the invention to provide novel methods and apparatus for loading a repeater-type bow gun.

BRIEF SUMMARY OF THE PREFERRED EMBODIMENTS OF THE INVENTION

In order to accomplish at least some of the above discussed objects, the present invention entails a bow gun which comprises a body having a channel disposed therein, the channel including a projectile discharge opening. Stored projectiles are fed to the channel from a magazine. A bow is mounted on the gun body and carries a bow string. An impulse slide is disposed for reciprocal movement within the channel and is operably connected to the bow string. A cocking slide is disposed for reciprocal movement within the channel for shifting the impulse slide rearwardly in the channel. A manually actuable cocking lever is pivotally mounted to the gun body and is operably connected to the cocking slide. Actuation of the cocking lever effects rearward movement of the cocking slide to shift the impulse slide rearwardly toward a cocked position. A trigger retains the impulse slide in a cocked position and releases the impulse slide for forward movement toward a projectile under the bias of the bow string.

The gun body comprises a pair of housing sections releasably secured together. The housing sections are divided along a plane defined essentially by the central axis of the channel.

A portion of the impulse slide is disposed above the magazine chamber subsequent to the discharge of one projectile to prevent premature entry of another projectile into the channel.

An adaptor unit is provided for converting the bow gun into an ejector for mini-balls.

THE DRAWINGS

Other objects and advantages of the present invention will become apparent from the subsequent detailed description thereof in connection with the accompanying drawings in which like numerals designate like elements, and in which:

FIG. 1 is a side elevational view of a bow gun according to the present invention;

FIGS. 2, 3, and 4 are perspective views of different forms of dart-like projectiles to be discharged by the bow gun of the present invention;

FIG. 11 is a plan view of the bow gun with parts removed to expose the cocking lever mechanism;

FIG. 12 is a fragmentary sectional view taken along line 12—12 of FIG. 1;

FIG. 13 is a view similar to FIG. 12 depicting an alternate embodiment of the invention;

FIG. 14 is a view similar to FIG. 13 depicting the bow in a collapsed posture;

FIGS. 15, 16, and 17 are schematic side elevational views of the bow gun depicting a dart loading operation;

FIG. 18 is a side elevational view of the bow gun with one housing section removed depicting a mini-ball adaptor in accordance with the invention;

FIG. 19 is a perspective view of the mini-ball adaptor depicted in FIG. 18;

FIG. 20 is a fragmentary cross-sectional view of the mini-ball adaptor taken along line 20—20 of FIG. 19; and FIG. 21 is a side elevational view of the bow gun, in longitudinal section, depicting an alternate form of projectile biasing mechanism.

DETAILED DISCLOSURE OF THE PREFERRED EMBODIMENTS

Figures 1, 2, 3, 4:
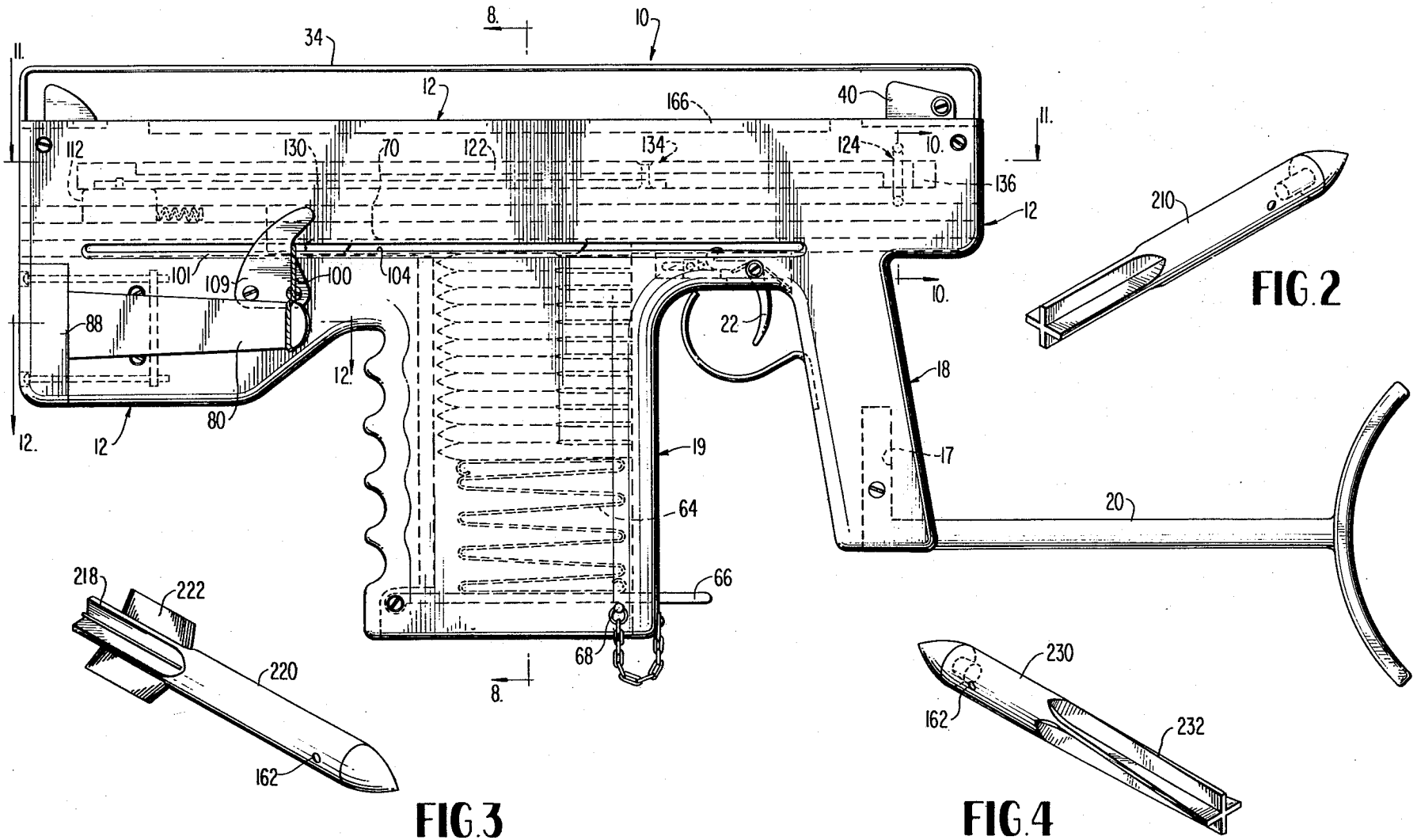
Figure 5:
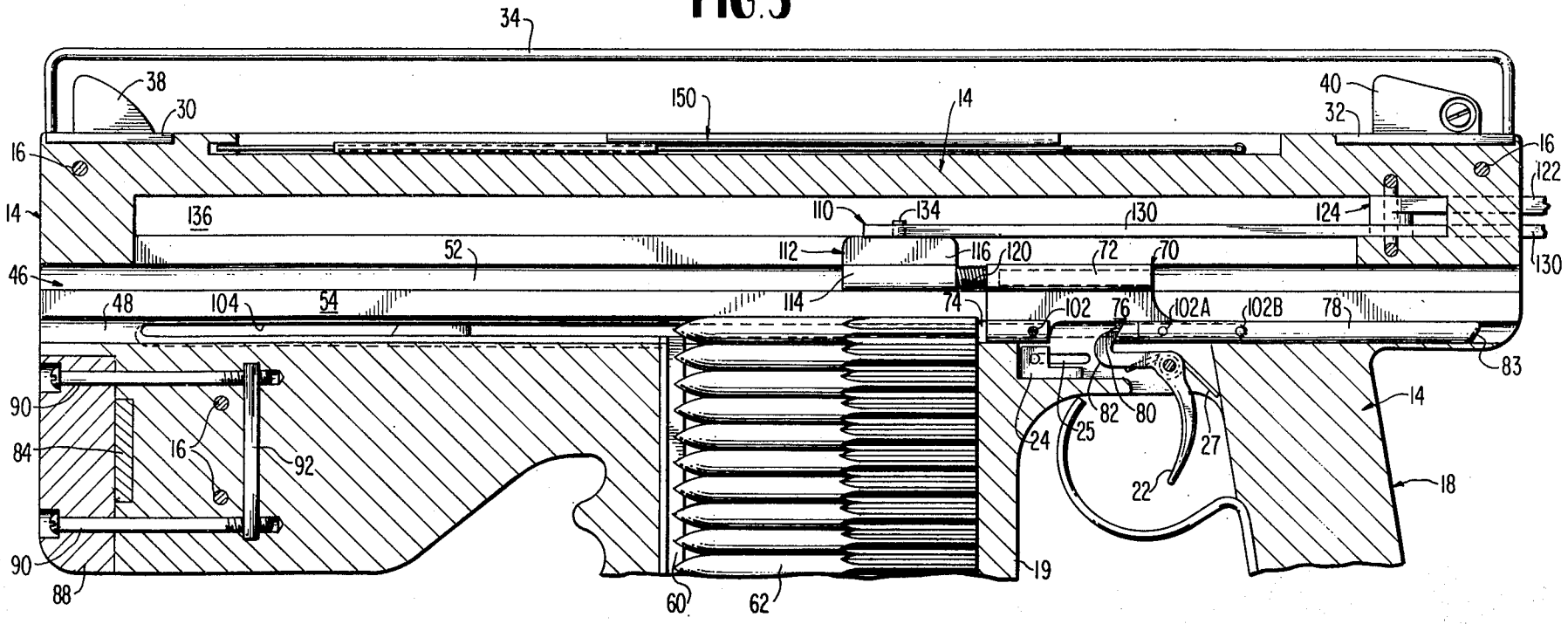
FIG. 5 is a partial side elevational view, in longitudinal section, of the assembled bow gun.
Figure 8:
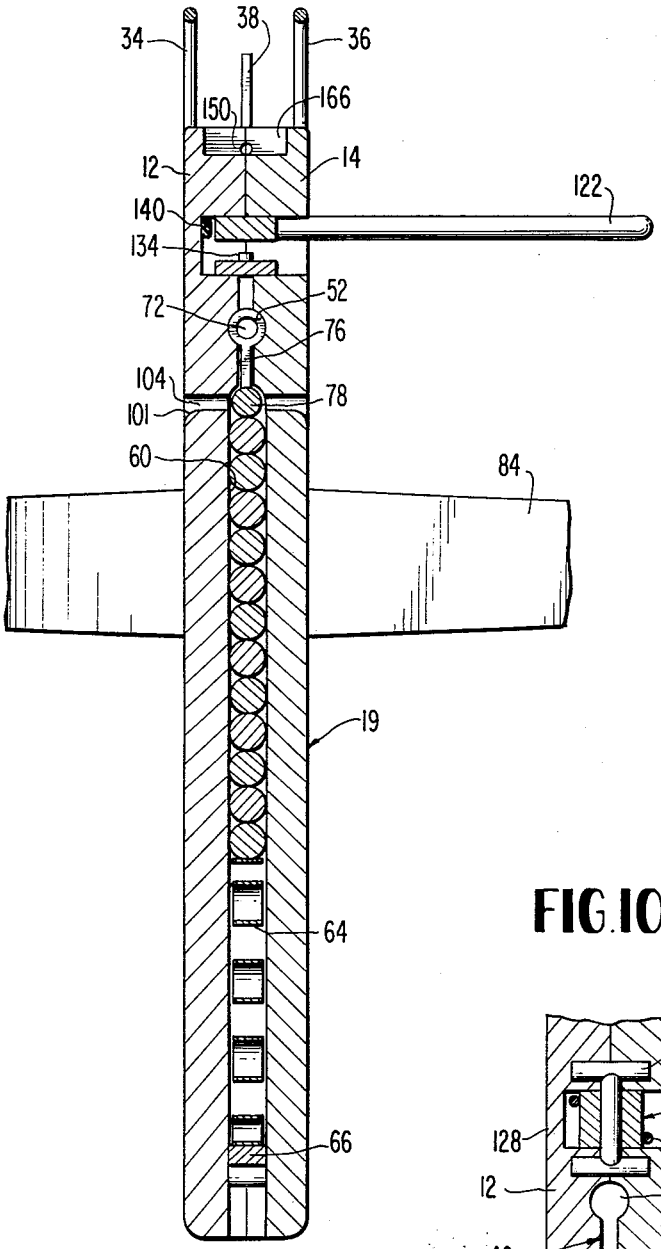
FIG. 8 is a cross-sectional view taken along line 8—8 of FIG. 1.
Figure 9:
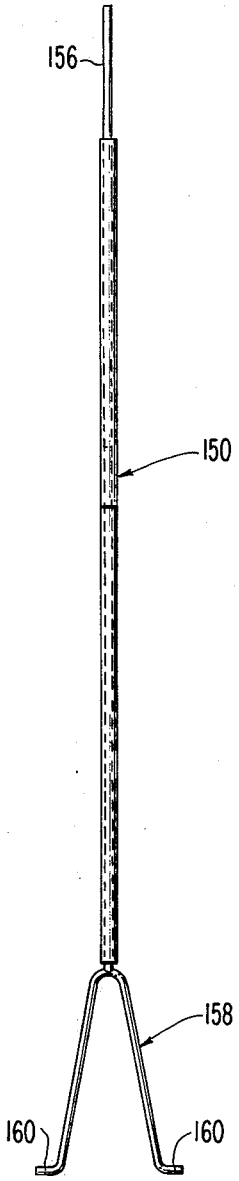
FIG. 9 is a side view of a projectile loading tool according to the invention.

The bow gun according to the present invention comprises a body 10 which is made up of a pair of housing sections 12, 14 (FIGS. 1, 5, and 8). The housing sections 12, 14 are joined together along a vertical plane intersecting the longitudinal axis of the body 10. The housing sections may be of any suitable material, preferably wood, and are held together by a plurality of fastening screws 16 extending transversely through the housing sections 12, 14. The body 10 includes a hand grip 18 disposed at the rearward end thereof and a magazine 19 located forwardly of the hand grip 18.

A plurality of cavities are suitated within the body 10, as will be subsequently described. These cavities serve to receive or guide certain portions of the bow gun. The arrangement is such that separation of the housing sections 12, 14 exposes these cavities to facilitate repair or maintenance of the bow gun. One such cavity comprises a recess 17 located in the hand grip 18 for receiving a removable stock member 20.

A trigger 22 is pivotally mounted on the gun body 10 forwardly of the hand grip 18 (FIGS. 1 and 5). A safety latch 24 is slidably mounted in a slot 25 in the housing so as to be manually movable to a rearward position wherein actuation of the trigger is prevented (FIG. 1). A spring 27 biases the trigger clockwise as viewed in FIG. 1.

At the top of the gun body 10 there is mounted a sighting unit 28. The sighting unit 28 comprises forward and rearward plates 30, 32 interconnected by means of right and left-hand rails 34, 36 (FIG. 8). The forward plate carries a front sight element 38 and the rearward plate carries a rear sight element 40 which could be mounted for elevational adjustment if desired. The rails 34, 36 provide a convenient handle for carrying the gun as well as for protecting the sight elements 38 and 40. The gun may also be inverted and rested on the rails to protect the wooden finish of the body 10, the rails thus serving as a stand for the gun.

Figure 10:
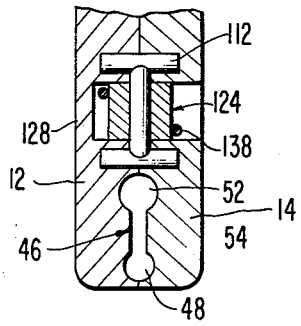
FIG. 10 is a fragmentary cross-sectional view taken along line 10—10 of FIG. 1.

Extending fore and aft within the body 10 is a main channel 46 (FIGS. 5 and 10). The channel 46 receives and guides the power transmitting components of the gun. In this regard, the channel 46 comprises a projectile discharge bore 48 having a front discharge opening 50, an upper bore 52 located above and extending parallel to the projectile discharge bore 42, and a vertically extending web slot 54 interconnecting the projectile discharge bore and the upper bore 52.

Communicating with the projectile discharge bore is a projectile storage chamber 60 in the magazine 18. The chamber 60 is shaped to store a plurality of projectiles, which may be in the form of a series of darts 62, for example. A spring 64 disposed between a rotatable door 66 of the magazine and the lowermost one of the projectiles 62 urges the projectiles upwardly toward the discharge bore 48 (FIG. 1). A removable pin 68, chained to the magazine 19, is insertable below the door 66 to secure it shut. The door can be spring biased toward an open position if desired. The front and rear sides of the chamber 60 can be lined with steel butt plates to minimize wear.

Slidably mounted within the channel 46 is an impulse slide 70 (FIG. 5). The impulse slide 70 includes a cocking head 72 slidably disposed in the upper bore 52 of the channel 46, an impact head 74 slidably disposed in the discharge bore 48, and a web 76 interconnecting the cocking head 72 and the impact head 74 and slidably received in the web slot 54. The impulse slide 70 is preferably fabricated of metal, with parts thereof, such as the cocking head 72, being hollowed out to minimize weight. The impulse slide 70 includes a tail portion 78 extending rearwardly from the web 76. The front surface 80 of the tail 78 defines a notch against which the stop arm 82 of the trigger abuts to hold the impulse slide 70 against movement. The rear surface 83 of the tail 78 is angled and functions as a cam during cocking operations to depress the trigger arm 82.

At the front end of the gun there is mounted a bow 84 (FIGS. 11, 12). A slot 86 is formed in the body 10 to receive the bow 84. A vise block 88 is fastened to the sections 12, 14 of the body 10 to clamp the bow 88 in place. This is accomplished through the use of bolts 99 which enter a pair of threaded recesses in a plate 92. This plate is embedded within a cavity formed in the body 10, the cavity being defined by mating recesses in the sections 12, 14 of the body 10.

The bow 84 extends laterally outwardly beyond the body sections 12, 14 and carries a bow string 100 between its outer ends (FIG. 11). The bow string 100 is operably connected to the impulse slide 70 by passing through an aperture 102 in the impact head 74. Additional aperatures 102A, 102B are provided in the impulse slide 70 to provide tension adjustment for the bow string in its cocked condition.

A pair of slots 104 (FIGS. 5 and 8) are provided in the discharge bore 48 in order to accommodate travel of the bow string 100 as the impact element 70 moves within the channel 46. The slots are preferably rounded at 101 to minimize frictional wearing of the bow string 100.

Adjacent the rear of the channel 46, a removable plate can be provided to shield the shooter from moving elements in the channel 46. In such an instance the rear end of the gun body can be made as long as necessary to enclose the impulse slide 70.

It will be apparent that with the impact element 70 retained within the channel 46 by the trigger 22, the bow and bow string will be cocked, with the bow string 100 exerting a forward bias on the impact element 70. In such a condition, actuation of the trigger will cause the impulse slide to be propelled forwardly such that the impact head 74 will strike the rearward end of a projectile 62 located thereahead and discharge the projectile from the discharge bore 48.

In order to brake the impulse slide 70, a nylon buffer 109 is mounted at each side of the gun body 10. The buffers are arranged to extend across the slot 104 at a point behind the cocking slide. In this fashion, the bow string engages the nylon buffer 109 and is swiftly braked.

In order to cock the bow there is provided a cocking assembly comprising a cocking linkage 110 and a cocking slide 112. The cocking slide 112 includes a cylindrical force transmitting piece 114 which slides within the upper bore 52 of the channel 46, and a flange 116 which slides within a slot 118 that communicates with the channel 46 (FIG. 8). A resilient coil spring 120 is mounted at a rearward end of the force transmitting piece 114 so as to be interposed between the cocking slide 112 and the impulse slide 70. Alternatively, other forms of resilient spring elements can be utilized, such as a cylindrical nylon member having transverse cuts to promote enhanced spring action.

Movement of the cocking slide 112 is effected by the cocking linkage 110. This linkage includes a lever arm 122 which is mounted on the gun body 10 for horizontal rotational movement about a bearing 124 (FIG. 10). The bearing 124 is generally H-shaped in cross-section and includes a releasable cap portion 126 which accommodates removal of the cocking arm 122 from a vertical shaft portion 128 of the bearing 124. A force transfer link 130 interconnects the lever arm 122 with the cocking slide 112. The link 130 is, by vertical pivot pins 132, 134, pivotally connected to the lever arm 122 intermediate its ends and to the flange 116. The lever arm 122 and the link 130 are received within a cavity 136 formed in the gun body 10. A torsin spring 138 is provided at the bearing 124 to bias the lever arm to a retracted position within the cavity 136. A buffer element 140 formed of rubber or other suitably resilient material is carried by the body 10 to absorb the impact of the lever arm 122 striking a wall 142 of the cavity 136 under the urging of the spring 138. Alternatively, the buffer could be mounted on the lever arm.

The lever arm 122 includes a handle 144 at the outer end thereof which may be grasped by an operator for pulling the lever arm outwardly from the cavity 136. Such rotational movement of the lever arm 122 produces rotational and translational movement of the link 30 to linearly shift the cocking slide 122 rearwardly.

It will be understood that the cocking linkage provides a mechanical force advantage, which may be on the order of three to one, to facilitate this cocking operation. The rearwardly propelled cocking slide 112 serves to push the impulse slide 20 rearwardly as the spring 120 engages the cocking head 72. The spring 120, although not necesssary, provides desirable shock buffering between the cocking and impulse slides 112 and 70. Alternatively, the spring 120 could be attached to the impulse slide or freely disposed in the upper bore 52 between the cocking and impulse slides 112, 70.

In any event, rearward movement of the cocking slide 112 is transmitted to the impulse slide 70 to shift the latter rearwardly within the channel 46 until the forward faces 80 of the tail element 78 is gripped by the trigger 22.

In order to load the gun with darts 62, the present invention includes a projectile installation tool 150 (FIGS. 9 and 15–17). The tool 150 includes a pair of sleeves 152, 154 that are bonded together. Alternatively, a single sleeve could be utilized. A rod 156 is insertable through the sleevee 152 and includes a bifurcated end 158 having a pair of tabs 160. To install a charge of darts 62 within the magazine chamber 60, the darts 62 are installed onto the tool 150 by passing the rod 156 through apertures 162 provided in the darts for this purpose. With the gun oriented in an upright position and the door 66 opened, the dart-carrying tool 150 is inserted into the chamber 60 (FIGS. 15 and 16). The gun is then inverted and the tool 150 is removed from the chamber 60 with the darts properly situated within the magazine chamber 60. Next, the spring 64 is inserted into the chamber and the magazine door 66 is closed and locked. The darts 62 are thus biased toward the discharge bore 48 ready for firing.

The installation tool 150 may be conveniently installed within a pocket 166 located at the top of the gun body 10 between the sight elements 38, 40. To this end, the pocket 166 includes three holes (not shown) one disposed at the front end of the pocket and the remaining two holes being disposed at rear sides of the pocket. The forward end of the rod 156 fits within the forward hole and the bifurcated tab portions 160 fit within respective ones of the rear side holes. The bifurcated tabs 160 may be installed by pinching the bifurcated end of the rod so as to compress the tabs 160 inwardly. The tabs will then spring outwardly into their respective holes under the inherent bias of the bifurcated portion 158.

OPERATION of the bow gun will be discussed from the point at which the gun is cocked and ready to fire. In such condition, the impulse slide 70 is located behind a dart 62 which is held within the discharge bore 48 by pressure from the spring 64. The impulse slide 70 is urged toward the projectile 62 by the cocked bow string 100 but is restrained by the trigger 22. When the trigger is actuated, the bow string 100 and the impulse slide 70 snap forwardly. In so doing, the impact head 74 engages the dart 62 and propels it from the discharge bore 48 at relatively high speed.

The impulse slide 70 travels forwardly in the channel until the bow string 100 is braked to a rest condition by the nylon buffers 109. In such a position, the tail 78 of the impulse slide 70 is disposed above the magazine chamber 60 so as to prevent the insertion of a new dart 62 into the discharge bore 48.

To recock the gun, the handle 144 of the lever arm 122 is grasped by the operator and pivoted about the bearing 124. The link 130 draws the cocking slide 112 rearwardly and retracts the impulse slide 70. When the face 80 of the impulse slide passes the trigger arm 82, the arm 82 catches the impulse slide and retains it in a cocked position (FIGS. 5 and 11). The spring 64, meanwhile, raises the column of darts 62, inserting a new dart 62 into the discharge bore 48 ahead of the impulse slide 70.

Upon release of the lever arm 122, the return spring 138 swings the lever arm 122 back into the cavity 136. The gun is now ready to fire the next shot. During one test firing an operator was able to fire six shots in approximately ten seconds.

When the magazine is empty, the gun may be reloaded by installing a new charge of darts 62 onto the rod 156 of the loading tool 150, inserting the tool into the magazine chamber (FIGS. 15 and 16), and inverting the gun and removing the loading tool 150 (FIG. 17). The spring 64 is reinserted and then compressed by closing and locking the door 66.

Access to the interior of the gun may be easily attained by removing the bolts 16 and separating the sections 12, 14. Since the channel 46 extends completely through the body 10, the impulse slide can be removed when the bow string 100 is removed therefrom without disassembling the sections 12, 14. Other elements, such as the bow 84, for example, can be removed without disassembling sections 12, 14. In this fashion, maintenance and replacement of parts is facilitated.

Figure 7:
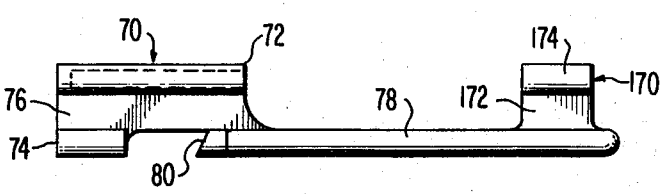
FIGS. 6 and 7 are side views of two alternate embodiments of an impulse slide in accordance with the present invention.

It will be apparent that numerous modifications of the bow gun are possible in keeping with the teachings of the basic invention set forth in the appended claims. For example, the impulse slide 70 could be provided with a support member 170 (FIG. 7). This support 170 includes a web 172 that travels in the web slot 54, and an upper cylindrical part 174 that slides in the upper bore 52. The support member 170 serves to resist tendencies of the impulse to become skewed within the channel 46, especially when the tail section is disposed above biased darts in the magazine chamber 60.

Figure 6:
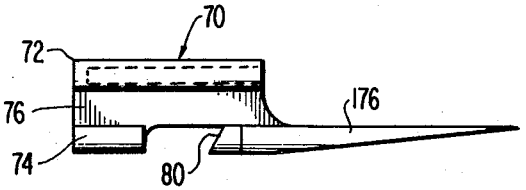

Alternatively, the impulse slide could be provided with an abbreviated tail section 176, as shown in FIG. 6. Due to its abbreviated length, the tail 176 would not prevent insertion of a new dart into the discharge bore 48 after a previous dart has been fired. The tail 176 includes a slanted surface 178 defining a cam face which cams the projectiles 62 downwardly into the magazine cavity during retraction of the impulse slide 70. The projectiles would be subsequently raised by the spring 64. If such a tail section 176 is used, it would be preferable to dimehsion that portion of the channel 46 located rearward of the magazine smaller than the darts to prevent the darts from being pushed rearwardly by the tail 176 during cocking.

Although the one-piece bow 84 is easily removed and installed for travel, it may be desirable to provide a bow gun of greater compactness, a collapsible bow can be utilized. As depicted in FIGS. 13 and 14, a collapsible bow arrangement according to the invention includes a centerpiece 180 and a pair of legs 182 hingedly attached thereto. The centerpiece 180 is secured to the gun body 10 by the vise block 88. At two of its corners 184, 186 the centerpiece 180 is arranged to receive brace pins 188, 190. These pins are each recessed along a corner so as to receive a toe portion 192 of a respective leg 182. Thus, by inserting the pins 188, 190 into the corners 184, 186 and pivoting the legs 182 so that the toe portions 192 enter the pin recesses, the legs 182 will be properly aligned through engagement with the pins 188, 190. With the bow being in a strung condition, i.e., with the bow string 100 being tautly disposed between the ends of the legs 182, the legs 182 will be biased against the pins to hold the latter in place. When pins become worn, they can be easily replaced.

In order to provide a more uniform application of force to the darts 62, a plate 200 (FIG. 21) can be positioned at the top of the spring 64. The plate 200 has arms 202, 204 which engage the sides of the magazine chamber 60 to assure that the darts will maintain their proper alignment during upward travel thereof within the magazine chamber 60. The plate 200 also includes an angled face 208 which faces the cocked impulse slide in the chamber 46 when the gun is empty. Upon subsequent firing the plate will thus be cammed downwardly by the impulse slide to avert the occurrence of damage.

The darts themselves can be of varying configuration. FIG. 2 illustrates on preferred form of dart 210 which includes a body 212 formed of suitably rigid, yet lightweight, material such as wood or plastic for example. A pointed head 214, fabricated preferably of steel, includes a neck 216 which is press-fit or glued into the body 212. The neck can also be tapered (FIG. 4) and can be embedded in a plastic dart body during manufacture. The body 212 is milled at the rear end thereof to establish a series of fins 218.

In FIG. 3 there is depicted an additional form of dart 220 which is similar to that previously described in connection with FIG. 2, except for the provision of feathers 222 between adjacent fins 218. The feathers are mounted so as to be capable of assuming a folded position within the discharge bore 48.

A modified dart form 230 is illustrated in FIG. 4 and includes a series of spirally shaped fins 232. Such a spiral shaping of the fins tends to produce a rotation of the dart during flight. The resulting centrifugal forces can add stability to the dart. If desired, feathers may be spirally arranged between the fins to heighten this effect.

In lieu of shooting darts the bow gun can be adapted to shoot mini-balls such as steel ball bearings. An adaptor unit 250, depicted in FIGS. 18 and 19, comprises a pair of housing sections that are united to define a horizontal leg 252 and a vertical leg 254. The legs 252, 254 include curved tracks 256, 258. The adaptor unit 250 is arranged to be attached within the magazine chamber 60 by bolts 260 to the housing section 14 of the gun body. The vertical track 258 cooperates with a wall 262 of the magazine chamber 60 to define a passage sized to receive a column of steel balls 264. A spring 266 is insertable into the vertical passage below the balls to bias the balls upwardly when the door 66 is closed. A rubber pad 268 is located at the top of the vertical track 258. The pad 268 has a V-shaped cut-out 269 at its top and a rounded cut-out 270 at its side to accommodate the balls. The pad 268 serves to frictionally grip the uppermost of the balls and retain it at the top of the vertical track 258 until the trigger is actuated, thereby allowing only one ball to enter the channel 46 at a time.

The horizontal track 256 defines a runway bridging the gap along the top of the magazine chamber 60. During discharge, the ball 264 is impacted by the impact head 74 and is propelled through the discharge bore. The pads 268, being resilient, deflect to accommodate passage of the impulse slide 70.

SUMMARY OF MAJOR ADVANTAGES OF THE INVENTION

The bow gun of the present invention provides a relatively simplified mechanism for producing a rapid accurate firing of projectiles. The impulse slide provides an effective means of discharging the projectiles while shielding the bow string from direct contact with the projectile and the cocking mechanism. In this manner, the bow string is spared the wearing which might otherwise occur.

The tail of the impulse slide affords a convenient means of retaining the projectiles out of the discharge bore during a gun cocking operation. Wear-producing contact between the bow string and the projectiles is avoided by such an arrangement.

The cocking slide and the impulse slide are located within the confines of the gun body and are thereby protected from abuse. Access to these and other parts of the gun is made convenient by the dual-section construction 12, 14 of the gun body which allows the inner cavities of the gun to be quickly and non-destructably exposed. Conveniently, the passage 46 extends from end-to-end to facilitate removal parts without separating the sections 12, 14.

The cocking lever provides a mechanical advantage for cocking the gun and automatically folds neatly within a recess so as to be out of the way until needed.

The loading tool 150 provides simplified loading of the gun such that the projectiles do not become skewed within the magazine cavity.

The collapsibility feature of the bow (FIGS. 13 and 14) contributes to the compactness of the gun while assuring proper alignment of the bow sections during operation.

Versatility of the gun is maximized by the mini-ball adaptor which affords quick and simplified conversion of the gun for a dart ejector to a ball type ejector.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A bow gun comprising:

a body having a channel disposed therein, said channel including a projectile discharge bore and a cocking bore, said discharge bore having a projectile discharge opening at a forward end thereof;

a magazine chamber communicating with said channel for storing a plurality of projectiles for sequential discharge;

a bow mounted on said body at a forward end thereof, said bow carrying a bow string; impulse slide means disposed for reciprocal movement within said discharge bore and including a cocking head disposed in said cocking bore;

said bow string being connected to said impulse slide means; cocking slide means disposed for reciprocal movement in said cocking bore relative to and ahead of said cocking head for shifting said impulse slide means rearwardly in said cocking bore;

a manually actuable cocking lever means pivotally mounted to said gun body and connected to said cocking slide to effect rearward movement thereof toward said cocking head to shift said impulse slide means rearwardly toward a cocked position; and triggering means for retaining said impulse slide means in a cocked position and for releasing said impulse slide means for forward movement toward a projectile in said discharge bore under the bias of said bow string.

2. Apparatus according to claim 1 wherein said gun body comprises a pair of housing sections releasably secured together; said housing sections being divided along a plane defined essentially by the central axis of said channel.

3. Apparatus according to claim 1 wherein said channel comprises a web slot interconnecting said discharge and cocking bores; said cocking bore being disposed above said discharge bore; said impulse slide means including an impact head slidable within said discharge bore and a web portion interconnecting said cocking head and impact head; said impact head being operable to contact and eject the projectiles being discharged.

4. Apparatus according to claim 1 wherein said impulse slide means includes a portion traveling in said discharge bore and which is disposed above said magazine chamber subsequent to discharge of one projectile to prevent premature entry of another projectile into said discharge bore.

5. Apparatus according to claim 1 wherein said impulse slide means includes a cam surface arranged to depress projectiles into said magazine chamber during retraction of said impulse slide means by said cocking lever.

6. Apparatus according to claim 1 and further including a link pivotally connected at one end to said cocking lever and pivotally connected at another end to said cocking slide to transmit force therebetween; and spring means for returning said cocking lever subsequent to a retracting operation.

7. Apparatus according to claim 1 and further including resilient buffer means operably interposed between said impulse slide means and said cocking slide means.

8. Apparatus according to claim 1 and further including a pair of sight elements disposed at the forward and rearward ends of said gun body; rail means interconnecting said sight elements and oriented in straddling relation thereto to define a carrying handle and support stand for the bow gun.

9. Apparatus according to claim 1 wherein said bow comprises a centerpiece and a pair of outer sections hingedly connected thereto, said outer sections being pivotal to a collapsed position generally parallel to the longitudinal axis of the gun body; and a pair of pins insertable between edges of said outer sections and said centerpiece to provide an orienting surface for said outer sections when the latter are positioned for operation; said pin means being constrained between said centerpiece and said outer sections by the tension of said bow string.

10. Apparatus according to claim 1 including a projectile loading tool securable in a storage compartment of said gun body; said tool including a rod; projectiles to be discharged including apertures for receiving said rod; said projectiles being aligned when installed onto said rod so as to be insertable as a unit into said magazine chamber with said gun body being in an upright position; said rod being removable from said projectiles with said gun body in an inverted position to deposit said projectiles in said magazine chamber.

11. Apparatus according to claim 10 wherein said magazine chamber is adapted to receive a charge of darts, spring means being provided to bias a charge of darts upwardly toward said discharge bore, and closable door means for retaining and compressing said spring means in said magazine chamber.

12. Apparatus according to claim 11 further including darts, each of said darts comprise a metallic body, a pointed head press-fit into one end of said body, the other end of said body being milled to define an array of fins.

13. Apparatus according to claim 12 wherein said fins are spirally oriented.

14. Apparatus according to claim 1 wherein said magazine chamber is adapted to receive a charge of elongated projectiles; an adaptor unit being disposable in said magazine housing to convert said gun into a ball-ejecting gun; said adaptor unit including a vertical track for carrying a column of balls, and a horizontal track aligned with said channel for guiding a ball of said column during discharge thereof from said gun.

15. Apparatus according to claim 1 including a pair of resilient buffers disposed across the forward end of travel of said bow string to brake said bow string after a shot is fired.

* * * * *